US007647804B2

(12) United States Patent
Inoue et al.

(10) Patent No.: US 7,647,804 B2
(45) Date of Patent: Jan. 19, 2010

(54) LARGE STRAIN-INTRODUCING WORKING METHOD AND CALIBER ROLLING DEVICE

(75) Inventors: Tadanobu Inoue, Tsukuba (JP); Shiro Torizuka, Tsukuba (JP); Eijiro Muramatsu, Tsukuba (JP); Kotobu Nagai, Tsukuba (JP)

(73) Assignee: National Institute for Materials Science, Ibaraki (JP)

( * ) Notice: Subject to any disclaimer, the term of this patent is extended or adjusted under 35 U.S.C. 154(b) by 338 days.

(21) Appl. No.: 10/557,412

(22) PCT Filed: May 20, 2004

(86) PCT No.: PCT/JP2004/007279

§ 371 (c)(1),
(2), (4) Date: Feb. 16, 2006

(87) PCT Pub. No.: WO2004/103591

PCT Pub. Date: Dec. 2, 2004

(65) Prior Publication Data

US 2006/0260375 A1 Nov. 23, 2006

(30) Foreign Application Priority Data

May 20, 2003 (JP) ..... 2003-180291

(51) Int. Cl.
*B21B 13/00* (2006.01)
*B21B 13/10* (2006.01)

(52) U.S. Cl. ..... 72/225; 72/234; 72/235

(58) Field of Classification Search ..... 72/224–226, 72/234, 278, 282, 467, 235, 252.5
See application file for complete search history.

(56) References Cited

U.S. PATENT DOCUMENTS 6,092,408 A * 7/2000 Fabris ..... 72/235

FOREIGN PATENT DOCUMENTS

JP 62-174703 11/1987
JP 1-181939 7/1989

* cited by examiner

*Primary Examiner*—Dana Ross
*Assistant Examiner*—Debra M Sullivan
(74) *Attorney, Agent, or Firm*—Wenderoth, Lind & Ponack, L.L.P.

(57) ABSTRACT

A method of rolling a material in two more continuous passes is disclosed. The method includes rolling the material with a flattened-shaped caliber in a first pass, and subsequently rolling with a square-shaped caliber in a second pass. The rolling is performed with a first pass caliber having a flattened shape, wherein the ratio of the length ($2A_{01}$) of minor axis of the first pass caliber to an initial width ($2A_0$) is $(A_{01}/A_0) \leqq 0.75$; and a second pass caliber, wherein the ratio of a diagonal dimension ($2A_{S1}$) of the second pass caliber to the length ($2B_1$) of the major axis of the material after the first pass is $(A_{S1}/B_1) \leqq 0.75$ to introduce the large strain into the material.

4 Claims, 7 Drawing Sheets

LARGE STRAIN-INTRODUCING WORKING METHOD AND CALIBER ROLLING DEVICE

BACKGROUND OF THE INVENTION

1. Field of the Invention

The present invention relates to a large strain-introducing working method and a caliber rolling device for use in the working method.

2. Description of the Related Art

As a steel bar manufacturing method, there has been generally known a caliber rolling method using rolls having caliber grooves. Caliber shapes can be generally categorized as either angular (e.g., square or diamond), oval, or round. By combining these calibers properly (in a "pass schedule"), the cross-sectional area of a work piece can be efficiently reduced, and the work piece can be finished into a wire rod of a predetermined size. At this time, it is important to find a way to reduce the cross-sectional area efficiently and, thereby, achieve a predetermined shape precisely.

In the caliber designs of the prior art, however, attention has only focused on the area reduction ratio and the cross-section shape. This is problematic because the metal structure is coarser at the center than on the surfaces. This is mainly caused by the fact that a strain equivalent to that on the surface is not introduced into the central portion of the metal structure. If, therefore, a large strain can be introduced into the entire metal structure with an area reduction ratio and a pass number similar to or smaller than those of the prior art, the structural homogeneity can be enhanced to industrially generate a metal structure having a fine grain structure.

Also, the above-mentioned caliber designs are intended for hot working. In hot working, the strain or stress introduced in one pass can be released by the recovery/recrystallization of the structure between the passes. This raises a problem that the influences of the strain distribution introduced after one pass upon the strain distribution and the cross-sectional shape after the following pass cannot be estimated.

Therefore, an objective of the present invention is to solve the aforementioned problems of the prior art and to provide a novel technical means for clarifying the influences of the strain distribution introduced in the first pass upon the strain distribution and the cross-section shape after the next pass, thus enabling introduction of large strain into the entire cross-section of a material, particularly at the center of the material.

SUMMARY OF THE INVENTION

In order to solve the above-specified problems, according to a first aspect of the present invention, there is provided a working method of rolling a material with calibers in two or more continuous passes, comprising rolling with a flattened-shaped caliber in a first pass, and subsequently rolling with a square-shaped caliber in a second pass, in which the ratio of the minor axis $2A_{01}$ of the first pass flattened shape (oblong) caliber to the original width between opposing sides $2A_0$ of the material is set to be $A_{01}/A_0 \leqq 0.75$, and in which the ratio of a vertical diagonal dimension $2A_{s1}$ of the second pass square-shaped caliber to the length of the major axis $2B_1$ of the material after the first pass is set to be $A_{s1}/B_1 \leqq 0.75$, thereby introducing a large strain into the material.

According to a second aspect, there is provided a working method, wherein the caliber sets the ratio of the length $2A_{01}$ of the minor axis to the length $2B_{01}$ of the major axis of the flattened-shaped caliber in the first pass to be $A_{01}/B_{01} \leqq 4$.

According to a third aspect, there is provided a working method, wherein the caliber sets the ratio of the radius of curvature $r_{01}$ of the flattened caliber in the first pass to be at least 1.5 times that of the original width between opposing sides $2A_0$ of the material.

According to a fourth aspect, there is provided a working method, wherein all the rolling pass schedules include at least one flat-angular caliber.

According to a fifth aspect of the present invention, there is provided a rolling device which defines a flattened (oblong-shaped) caliber for a first pass, wherein the ratio of the length $2A_{01}$ of the minor axis of the flattened caliber in the first pass to the length $2B_{01}$ of a major axis of the flattened caliber is $A_{01}/B_{01} \leqq 0.4$; and a second caliber for a second pass, wherein the ratio of the vertical diagonal dimension $2A_{s1}$ of the second caliber to the length $2B_{01}$ of the major axis of the material after the first pass is $A_{s1}/B_1 \leqq 0.75$.

According to a sixth aspect, there is provided a rolling device which defines a flattened (oblong) caliber, wherein $A_{01}/B_{01} \leqq 0.4$, and the radius of curvature $r_{01}$ of the flattened caliber is at least 1.5 times that of the original width between opposing sides $2A_0$ of the material.

According to a seventh aspect, there is provided a rolling device for rolling a material with calibers in two or more continuous passes, which defines a first caliber which is one of those described above, and a second caliber having a shape different from the first caliber, so that the rolling is carried out with two calibers.

DETAILED DESCRIPTION OF THE INVENTION

Figure 1:
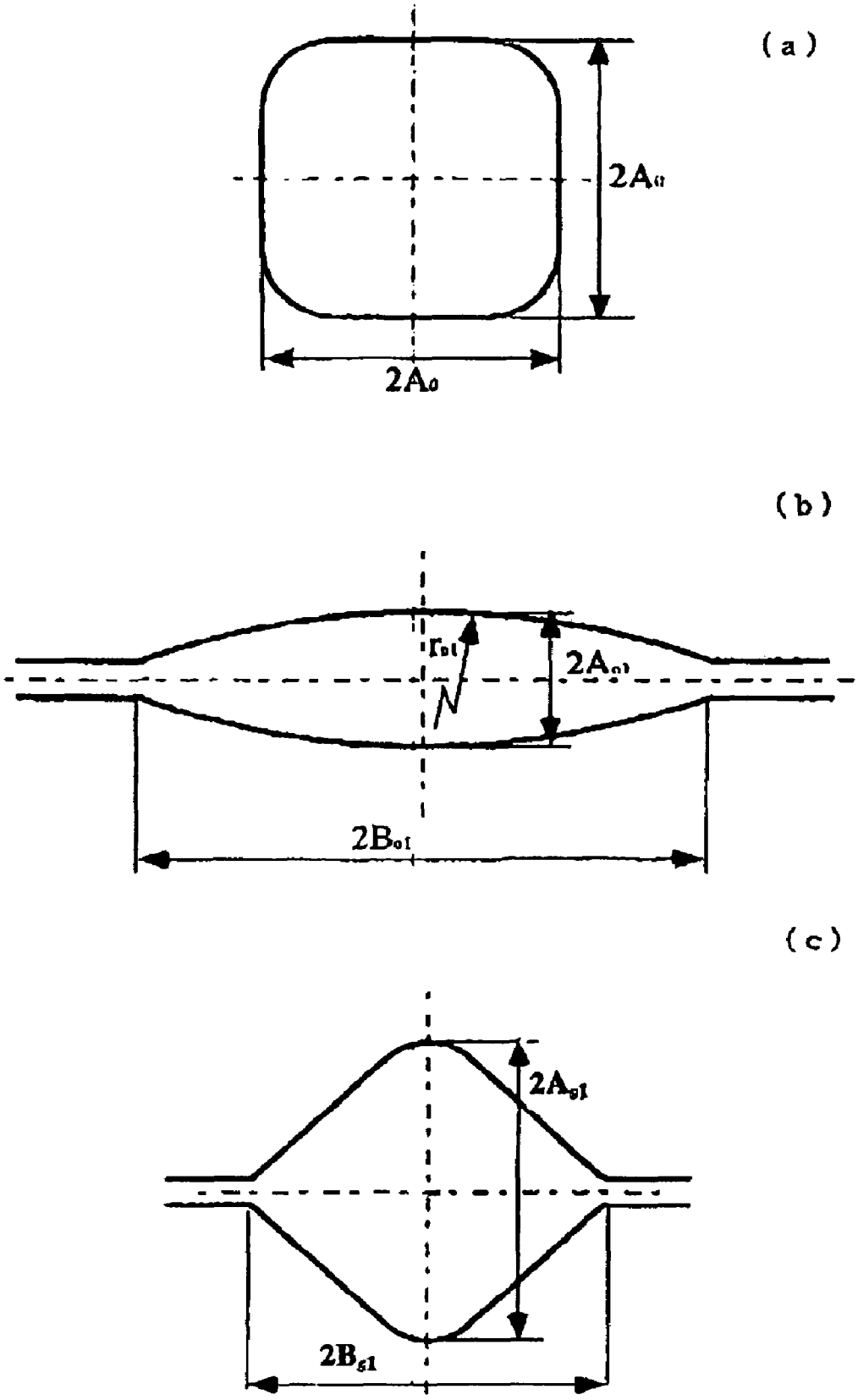
FIG. 1 illustrates a working material (work piece) and a caliber of the present invention.

The characteristics of the caliber(s) of the present invention will be described with reference to FIG. 1.

<1> Relationship Between the Length of the Minor Axis of the Flattened Caliber and the Original Material Width Between Opposing Sides of the Material If the nominal compression ratio=$(2A_0-2A_{01})/2A_0$) at the time of using the flattened-shaped caliber in a first pass is small, hardly any strain is introduced into the center of a material. In order to introduce strain into the cross-sectional area of the material by the first pass, therefore, the nominal compression ratio has to be enlarged. This makes it necessary that the ratio of the length $2A_{01}$ of the minor axis of the flattened caliber used in the first pass to the original width between opposing sides $2A_0$ of the material has to be 0.75 or less. If this ratio is larger than 0.75, the material will flow into the roll gap in the square-shaped caliber of the next pass. The result is not only that the cross-sectional shape of the material cannot be held, but also that the stored strain is low. If, moreover, the vertical diagonal dimension $2A_{s1}$ of the second pass caliber is enlarged, giving preference to the cross sectional shaping, thereby enlarging the ratio $A_{s1}/B_1$ (i.e., the length of the vertical diagonal dimension 2 As1 to the length $2B_1$ of the major axis of the material after the first pass), the nominal compression ratio then becomes so low that, though satisfactory shaping is achieved, large strain cannot be introduced into the material.

<2> Ratio of the Minor Axis Dimension to the Major Axis Dimension of the Flattened Caliber The present invention makes the large strain introduction compatible with the cross-sectional shape. The strain and the cross-sectional shape to be introduced into the material greatly depend upon not only the nominal compression ratio of the first pass, but also the constraint which is applied by the shape of the flattened caliber, along the major axis. As the ratio between the minor axis dimension and the major axis dimension of the flattened caliber becomes smaller, the nominal reduction in the later second pass can be made larger, thereby having the effect of greater strain introduction. For this effect, it is desired that the ratio of the minor axis dimension to the major axis dimension of the flattened caliber is 0.4 or less.

<3> Radius of Curvature of the Flattened Caliber

If the radius of curvature $r_{01}$ of the flattened caliber is small, a large area reduction ratio per pass can be made, but the reduction is sharp in the width direction. Even if the nominal pressure drop ratio in the second pass is large, the strain cannot be introduced into the center of the material. For the purpose of good shaping and large strain introduction after the next pass, the radius of curvature $r_{01}$ of the flattened caliber should be at least 1.5 times the original width between opposing sides $2A_0$ of the material. Both the shaping and the large strain introduction are efficiently satisfied at 1.5 times or more, but little change in the influence occurs beyond 5 or 6 times. Therefore, there is no upper limit, but the lower limit is 1.5 times the original width of the material.

<4> Rolling Pass Including a Flattened Caliber

By using the flattened caliber, as proposed, in combination with the oval-square or the oval-round caliber series of the prior art, it is possible to form a cross-section of highly precise shape and to introduce large strain into the center of the material.

The rolling method of the present invention can be applied not only to metal material, but also to all bar rods that are manufactured by groove rolling. Of these, large strain can be easily and efficiently introduced over a wide range into metal material with good hardenability. For example, large strain can be more easily introduced into stainless steel, which has excellent hardenability (i.e., a large n value), than into low-carbon steel. The required large strain of 1.0 is introduced at the center of the cross-section, through a square-flattened-square caliber series (2 pass). Moreover, it is desired that a strain of 1.0 or more is introduced into at least 60% of the cross-sectional area of the material. Then, it is possible to form a zone of fine crystal grains in the metal material.

The present invention is described in more detail in by the following examples, although the invention should not be limited by the examples.

EXAMPLES

Figure 2:
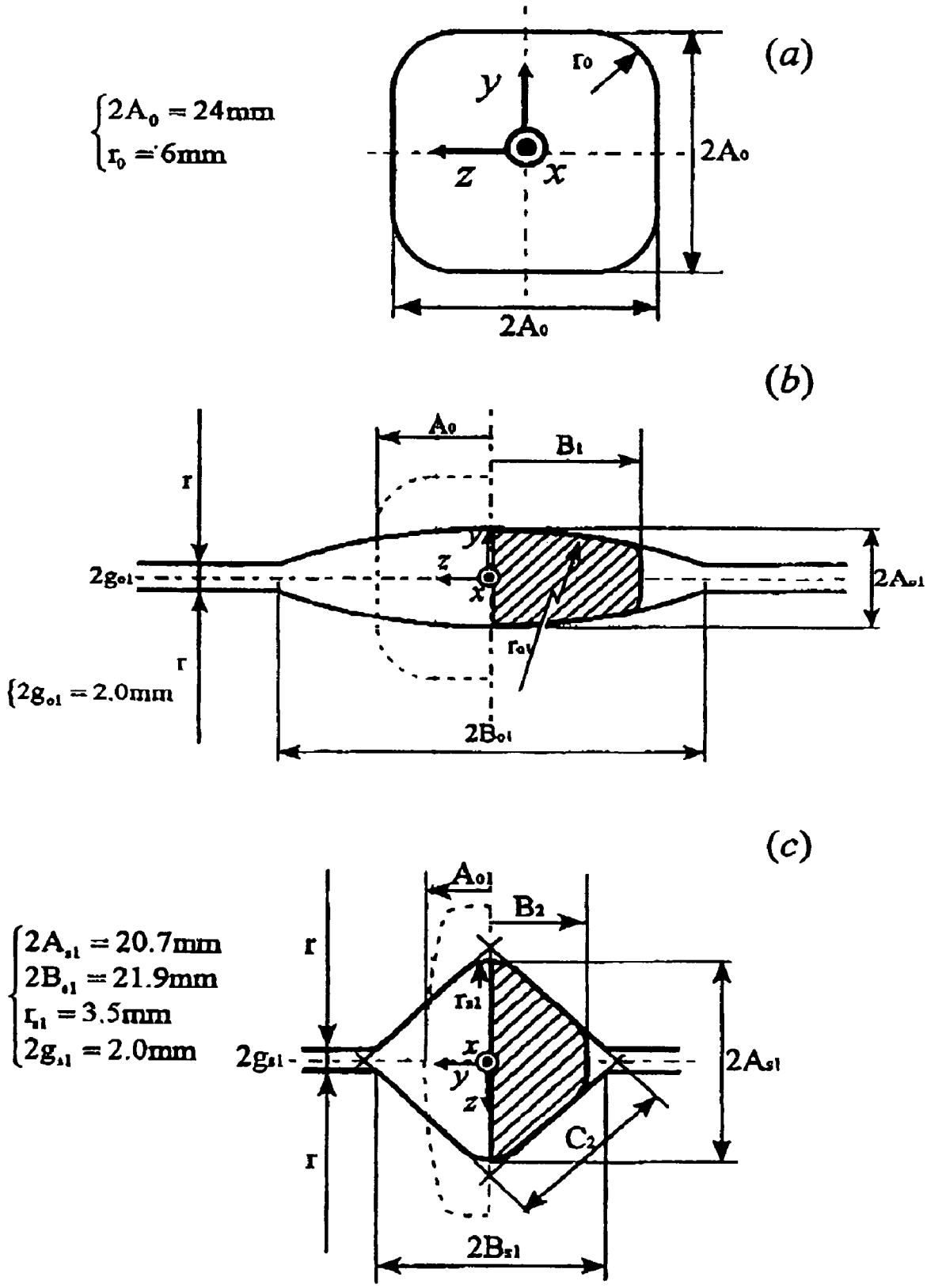
FIG. 2 illustrates the shapes and sizes of the calibers in an embodiment of the present invention.

A test piece was a 24 mm square steel bar. The steel bar is SM490 steel containing 0.15C-0.3 Si-1.5 Mn-0.02 P-0.005 S-0.03 Al. Two-pass groove rolling was performed with the calibers shown in FIG. 2. The initial material was the 24 mm square steel bar shown in FIG. 2(*a*). This steel bar was flattened-rolled (for the first pass), as shown in FIG. 2(*b*), and was then turned by 90 degrees, and rolled (for the second pass) into an 18 mm square steel bar by the square caliber shown in FIG. 1(*c*). The rolling temperature was constant at 500° C., and both the rolls had a diameter of 300 mm and a revolving speed of 160 rpm. On the other hand, the roll gap was 3 mm for the flattened caliber shown in FIG. 1(*b*), but 2 mm for the square caliber. The plastic strain introduced into the test materials by the rolling was calculated by using the general finite element code ABAQUS/Explicit. In the analyses, the stress-strain dependence upon the temperature and the strain speed measured in actual tests were employed as the characteristics of the material. The conditions of contact between the rolls and the test pieces were determined so that the friction coefficient $\mu$=0.30 under Coulomb conditions. Incidentally, the rolls were rigid.

Example 1

The flattened caliber used had a height $2A_{01}$=12 mm, a width $2B_{01}$=47.1 mm and the radius of curvature $r_{01}$=64 mm, as shown in FIG. 2(*b*).

Example 2

The flattened caliber used had a height $2A_{01}$=16 mm, a width $2B_{01}$=47.1 mm and the radius of curvature $r_{01}$=46 mm, as shown in FIG. 2(*b*).

Example 3

The flattened caliber used had a height $2A_{01}$=18 mm, a width $2B_{01}$=47.1 mm and the radius of curvature $r_{01}$=40.8 mm, as shown in FIG. 2(*b*).

Example 4

The flattened caliber used had a height $2A_{01}$=12 mm, a width $2B_{01}$=32.7 mm and the radius of curvature $r_{01}$=32 mm, as shown in FIG. 2(*b*).

Comparison Example 1

The flattened caliber used had a height $2A_{01}$=20 mm, a width $2B_{01}$=47.1 mm and the radius of curvature $r_{01}$=36.94 mm, as shown in FIG. 2(*b*).

Comparison Example 2

In Example 1, the strain after the first pass was released so that the material was without stress and strain (only the cross sectional shape was imparted), and the square rolling was then performed.

Figure 3:
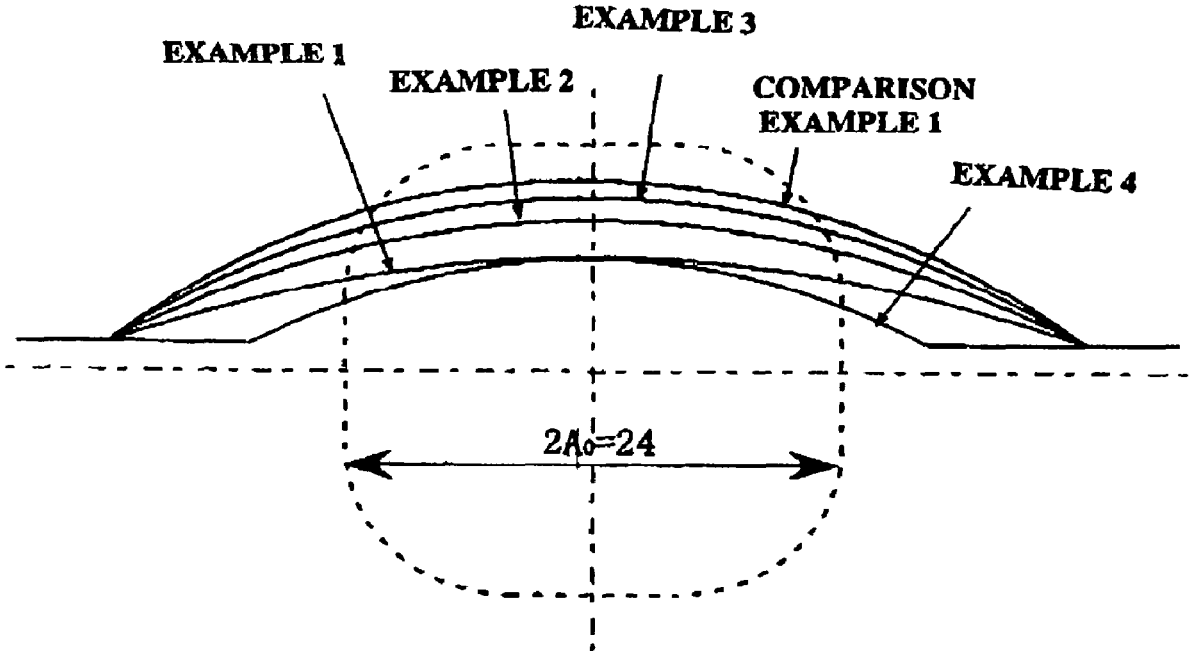
FIG. 3 is a diagram of the shapes of the flattened-shaped caliber in various embodiments of the present invention.

Table 1 lists the dimensions of the flattened caliber of Examples 1 to 4 and Comparison Example 1. FIG. 3 is a diagram showing geometrical relationship between the original cross sectional shape of the material and the flattened caliber shapes in those cases.

TABLE 1

| | Flattened Calibers | | | | Relations with Original Material | | |
|---|---|---|---|---|---|---|---|
| | Height | Width | Radius of Curvature | Caliber Ratio | | | |
| | $2A_{01}$ | $2B_{01}$ | $r_{01}$ | $A_{01}/B_{01}$ | $A_{s1}/B_1$ | $A_{01}/A_0$ | $r_{01}/A_0$ |
| Example 1 | 12 | 47.1 | 64 | 0.25 | 0.61 | 0.50 | 2.67 |
| Example 2 | 16 | 47.1 | 46 | 0.34 | 0.69 | 0.67 | 1.92 |
| Example 3 | 18 | 47.1 | 40.8 | 0.38 | 0.74 | 0.75 | 1.70 |
| Example 4 | 12 | 32.7 | 32 | 0.37 | 0.60 | 0.50 | 1.33 |
| Comparison Example 1 | 20 | 47.1 | 36.94 | 0.42 | 0.78 | 0.83 | 1.54 |

Figure 4:
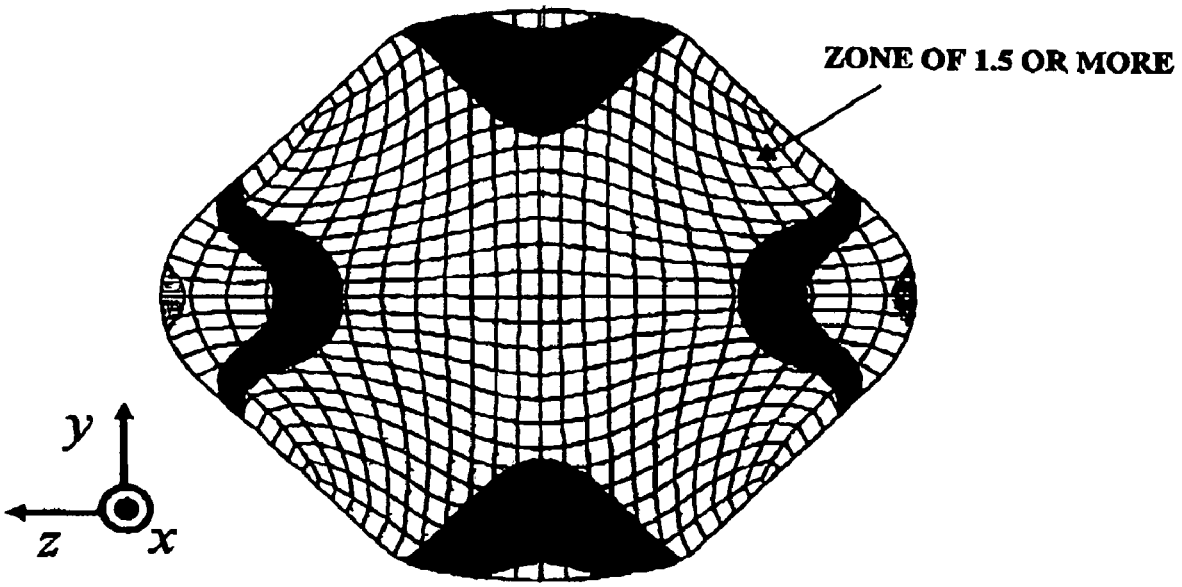
FIG. 4 is a diagram of the cross sectional shape and a strain distribution after two passes in one embodiment (Example 1) of the present invention.

FIG. 4 shows a distribution of the strain in the cross section of the material of Example 1.

The inclined cross-shape zone at the center of FIG. 4 designates the zone having strain of 1.5 or more. The area reduction ratio of the 24 mm square material is 53%. The ordinary strain, as calculated from the area reduction ratio is 0.87, but a strain as large as 1.5 is introduced into 70% of the cross section by passage through the flattened caliber. An extension of this strain is found from the center toward the four sides. Moreover, a strain of 1.0 or more is introduced into 99% of the cross section, and a strain of 1.8 or more is introduced into 9%. Here, the strain at the cross section center is quite large, 1.81.

Table 2 gives the strains introduced into the center section and respective proportions of the cross section with strains of 1.0 and 1.8 or more, in the cases of the flattened calibers of Examples 1 to 4 and Comparison Example 1. In Comparison Example 1, the center strain is less than 1.0, and the proportion of the cross section with strain of 1 or more is less than 60%.

TABLE 2

| | Strain Area Percentage (%) | | |
|---|---|---|---|
| | 1.0 or more | 1.8 or more | Center Strain |
| Example 1 | 99.2 | 8.5 | 1.81 |
| Example 2 | 99.4 | 0.0 | 1.34 |
| Example 3 | 84.7 | 0.0 | 1.09 |
| Example 4 | 100.0 | 16.0 | 1.62 |
| Comparison Example 1 | 54.8 | 0.0 | 0.86 |

Figure 5:
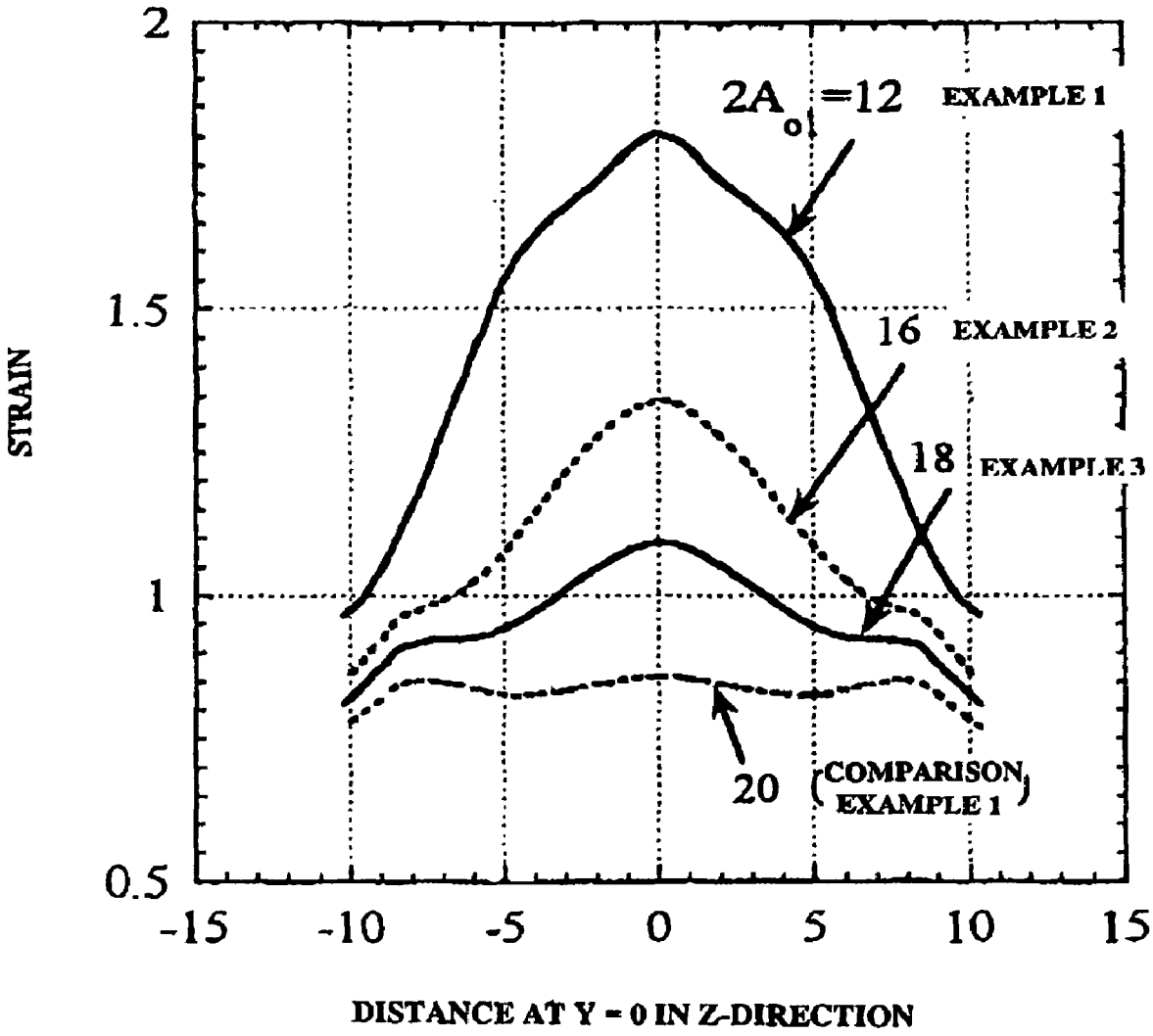
FIG. 5 is a graph plotting strain distributions in the z-direction after two passes.

FIG. 5 is a graph plotting strain along the z-axis through the cross section center after the square rolling with the flattened calibers of Examples 1 to 3 and Comparison Example 1. The strain is at a maximum at the section center in Examples 1 to 3, for example: 1.81 in Example 1; 1.34 in Example 2; and 1.09 in Example 3.

In Comparison Example 1, the strain is substantially 0.86 at all positions, smaller than that of Examples 1 to 3. The area reduction ratios after two passes of the material are 53%, 49% and 51% in Examples 1 to 3, respectively, and 47% in Comparison 1, which are not very different. However, the strains actually introduced into the material are different.

Figure 6:
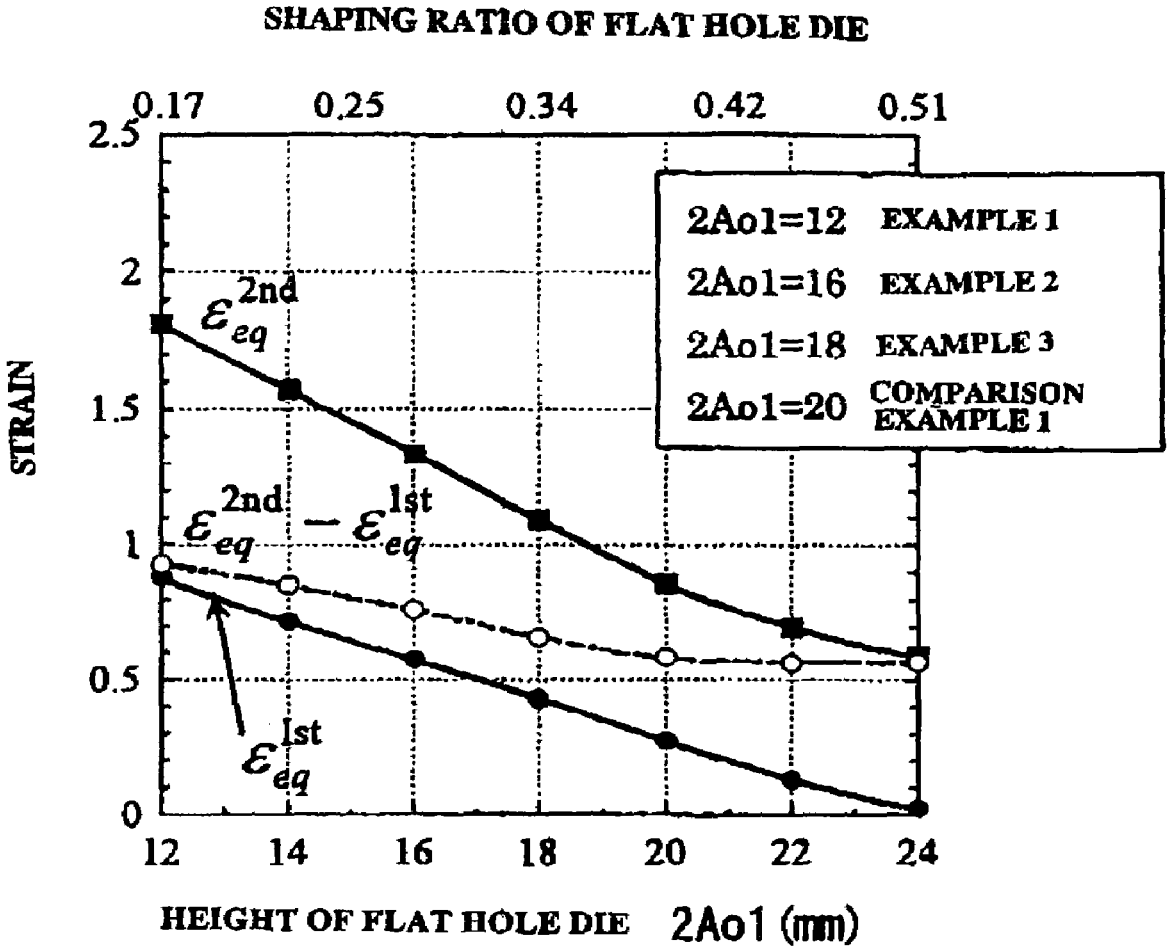
FIG. 6 is a graph plotting changes in the strain at the center of a material introduced by a pass through various flattened calibers, relative to the height of the flattened caliber.

FIG. 6 is a graph plotting relationship between the strain introduced into the material centers after the flattened caliber rolling (the first pass) and after the subsequent flattened-square rolling (the second pass), and the heights of the square caliber. In FIG. 6:

$$\epsilon_{eq}^{1st} \quad \text{Expression 1}$$

indicates the strain introduced after the first pass;

$$\epsilon_{eq}^{2nd} \quad \text{Expression 2}$$

indicates the strain introduced after the second pass; and $$\epsilon_{eq}^{2nd}-\epsilon_{eq}^{1st} \quad \text{Expression 3}$$

indicates the strain, which is calculated by subtracting the strain after the first pass from the strain after the second pass, that is, the strain introduced in the second pass.

From FIG. 6, it is apparent that the strain introduced in the second pass does not change from the flattened caliber height of 20 mm onward. In the prior art, the working method is performed the more for the larger area reducing ratio so that a large strain is introduced into the material. The area reduction ratios in the second pass are 28%, 32%, 34%, 41%, 41%, 41% and 41%, respectively, for the heights $\mathbf{2}A_{01}$ of the flattened caliber $\mathbf{2}A_{01}$=12, 14, 18, 20, 22 and 24. In short, the larger the strain increase, the smaller the area reducing ratio. This is highly influenced by the strain distribution introduced in the first pass. The area reducing ratio is constant at 41% where the height $\mathbf{2}A_{01}$ of the flattened caliber $\mathbf{2}A_{01}$=18 mm or more, and the strain is substantially constant at 0.58 for $\mathbf{2}A_{01}$=20 mm or more. If it is assumed that when the area reducing ratio is 41%, the strain is homogeneously introduced and the strain is calculated to be 0.60, substantially equal to the strain introduced when $\mathbf{2}A_{01}$=20 mm or more. This means that the strain distribution introduced in the first pass does not contribute to the strain introduction in the second pass. In the present invention, the height ($\mathbf{2}A_{01}$) of 12 mm of Example 1 increases the strain efficiently (with a small area reduction). In short, the conditions and results of Example 1 show that the strain distribution introduced in the first pass effectively acts on the strain introduced in the second pass.

Figure 7:
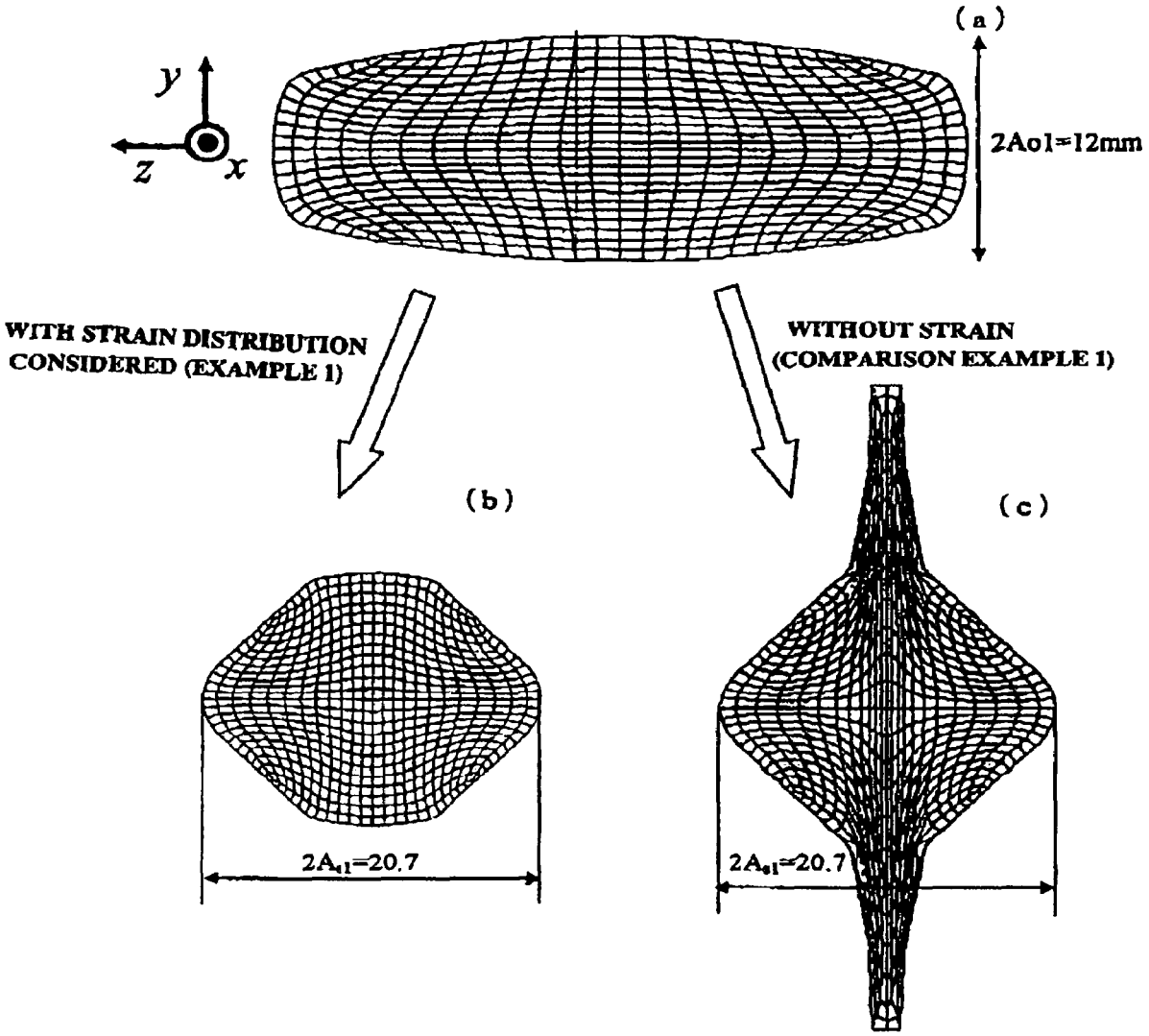
FIG. 7 illustrates the cross-sectional shapes of a material after rolling using a square caliber of the present invention.

FIG. 7 shows the cross sectional shapes of Example 1 and Comparison Example 2, which use the same flattened caliber. FIG. 7(*a*) shows the cross-sectional shape of the material after the first pass (i.e., the flattened rolling); FIG. 7(*b*) shows the cross-sectional shape (of Example 1) after the second pass (i.e., the square rolling); FIG. 7(*c*) shows the sectional shape (of Comparison 2) in the case where the second pass (i.e., the square rolling) was made after the structure recovered/recrystallized after the first pass (i.e., the flattened roller) so that the strain and the stress introduced by the first pass became zero again. If the strain distribution introduced into the material after the flattened rolling in the first pass did not exert large influence upon the cross-sectional shape introduced in the second pass, the cross-sectional shape of the material after the square rolling would be unchanged. However, as shown in FIGS. 7(*b*) and 7(*c*), the strain distribution makes a large difference. More specifically, in a caliber series such as square-flattened-square rolling, the cross-sectional shape after the second pass is greatly influenced by the strain distribution introduced in the first pass. Thus, when the strain from each pass is stored in the material, the relationship between the material shape and the square caliber present in the prior art does not exist. This means that the design of the square caliber considering the strain distribution introduced in the first pass plays a very important role.

As has been detailed here, the present invention solves the problems of the prior art and clarify the influences of the strain distribution introduced in the first pass upon the strain distribution and the shape after the next pass, thus enabling introduction of large strain into the entire cross-sectional area of the material, particularly at the center of the material.

The large strain introduced into the center of the material causes the metal material to have a homogeneous cross section structure. Moreover, the invention is useful for generating a metal material having a super-fine grain structure, since this structure requires large strain. Still further, since the strain distribution introduced in the first pass highly influences the magnitude and distribution of the strain after the second pass and the cross-sectional shape, the present invention provides a new technology for satisfactory cross-sectional shaping and structure generation at the same time, thereby making a great contribution to the design of caliber series.

The invention claimed is:

1. A working method comprising providing a work piece having an initial width ($\mathbf{2}A_0$); and rolling the work piece in at least two consecutive passes, wherein:

a first pass comprises passing the work piece through an oblong-shaped caliber having a minor axis and a major axis, a ratio of a length ($\mathbf{2}A_{01}$) of the minor axis to the initial width ($\mathbf{2}A_0$) of the work piece being $(A_{01}/A_0) \leqq 0.75$ so as to provide the work piece with a cross-section having a minor axis and a major axis; and a second pass comprises passing the work piece through a square-shaped caliber having a diagonal dimension ($\mathbf{2}A_{S1}$), a ratio of the diagonal dimension ($\mathbf{2}A_{S1}$) to a length ($\mathbf{2}B_1$) of the major axis of the cross-section of the work piece being $(A_{S1}/B_1) \leqq 0.75$ so as to introduce a large strain in the work piece.

2. The working method of claim 1, wherein a ratio of the length ($\mathbf{2}A_{01}$) of the minor axis of the oblong-shaped caliber to the length ($\mathbf{2}B_{01}$) of the major axis of the oblong-shaped caliber is $(A_{01}/B_{01}) \leqq 0.4$.

3. The working method of claim 1, wherein the oblong-shaped caliber has a radius of curvature ($r_{01}$) which is at least 1.5 times the initial width ($\mathbf{2}A_0$) of the work piece.

4. The working method of claim 2, wherein the oblong-shaped caliber has a radius of curvature ($r_{01}$) which is at least 1.5 times the initial width ($\mathbf{2}A_0$) of the work piece.

* * * * *